US006276908B1

(12) United States Patent
Batchelder et al.

(10) Patent No.: US 6,276,908 B1
(45) Date of Patent: Aug. 21, 2001

(54) LATCHING MECHANISM FOR USE WITH PUMPS USED IN MARINE ENVIRONMENTS

(75) Inventors: Scott K. Batchelder, Newbury; James T. Burrill, Gloucester, both of MA (US)

(73) Assignee: Rule Industries, Inc., Gloucester, MA (US)

( * ) Notice: Subject to any disclaimer, the term of this patent is extended or adjusted under 35 U.S.C. 154(b) by 0 days.

(21) Appl. No.: 09/521,215

(22) Filed: Mar. 8, 2000

Related U.S. Application Data

(63) Continuation-in-part of application No. 08/948,825, filed on Oct. 10, 1997, now Pat. No. 6,045,340.

(51) Int. Cl.[7] ..... F04B 17/00

(52) U.S. Cl. ..... 417/423.14; 417/360; 417/423.3; 417/423.7

(58) Field of Search ..... 417/423.14, 423.3, 417/423.7, 423.15, 360, 424.1; 60/535

(56) References Cited

U.S. PATENT DOCUMENTS

| | | | | |
|---|---|---|---|---|
| 3,000,543 | | 9/1961 | Paul | 222/333 |
| 3,822,498 | * | 7/1974 | Butler | 43/57 |
| 3,982,856 | | 9/1976 | Hehl | 417/360 |
| 4,084,377 | * | 4/1978 | Gaiser | 60/535 |
| 4,424,007 | | 1/1984 | Mehrens et al. | 417/360 |
| 4,734,016 | | 3/1988 | Sailer | 417/360 |
| 4,880,364 | | 11/1989 | Berfield et al. | 417/423 |
| 4,904,166 | | 2/1990 | Wasemann | 417/360 |
| 4,913,620 | * | 4/1990 | Kusiak et al. | 415/211.1 |
| 5,044,883 | | 9/1991 | Neuder | 415/214 |
| 5,232,341 | | 8/1993 | Sheier et al. | 415/201 |
| 5,356,105 | * | 10/1994 | Andrews | 248/221.3 |
| 5,538,406 | | 7/1996 | Siegal et al. | 417/360 |
| 5,833,437 | * | 11/1998 | Kurth et al. | 417/423.14 |

* cited by examiner

*Primary Examiner*—Timothy S. Thorpe
*Assistant Examiner*—Michael K. Gray
(74) *Attorney, Agent, or Firm*—Dickstein Shapiro Mori & Oshinsky LLP

(57) ABSTRACT

A pump for use in marine environments including a pump housing having a cap portion and a main portion, a pump intake pipe attached to the main portion, a pump assembly attached to the cap portion is described. A pair of clips extending from said cap portion extend over a pair of raised surfaces on said main portion. Rotation of the cap portion moves said clips from a low end of the raised surfaces to a high end, thereby locking the cap portion to the main portion. In another embodiment, a locking ring fits over the junction between the cap portion and the main portion. The ring includes an inwardly directed upper flange and a plurality of inwardly directed protrusions on a lower extent. The ring fits over the cap portion such that a flange from the motor housing and one or more flanges from the main portion are caught between the upper flanges and the protrusions of the locking ring. The pump may be a removable live well pump or a bilge pump.

32 Claims, 12 Drawing Sheets

LATCHING MECHANISM FOR USE WITH PUMPS USED IN MARINE ENVIRONMENTS

This application is a continuation-in-part of application Ser. No. 08/948,825 filed on Oct. 10, 1997, now U.S. Pat. No. 6,045,340, the entirety of which is hereby incorporated by reference.

BACKGROUND OF THE INVENTION

1. Field of Invention

The present invention relates to pumps, and more particularly to a removable pump for a live well tank used in fishing vessels.

2. Description of Related Art

Commercial and recreational fishing boats typically include at least one on-board holding tank that stores bait or caught fish that need to be kept alive until the boat returns to shore. Pumps circulate water through these tanks in order to keep the bait and fish alive. The pump includes an intake pipe generally located below the boat's water line and a discharge pipe running to the tank. A drain tube discharges water overboard to maintain the proper water level in the tank. Conventional live well pumps are attached directly to the boat hull. The pump's intake pipe is inserted in a hole through the hull. The intake pipes are typically manufactured as part of a pump housing component in one integral piece.

The pumps circulate fresh and salt water and they often become clogged with debris and require cleaning. Furthermore, the individual pumps generally require repairs more frequently than the through-hull fitting. Because the intake pipe and pump housing are a single piece, removing the pump for cleaning or repair requires the removal of the intake pipe as well. When both the pump and intake pipes are removed, the hole formed in the boat hull is exposed. Therefore, the boat must be elevated, or removed from the water, or the hole in the boat hull itself must be plugged while the pump is serviced. Plugging the hole in the boat hull is difficult because this hole is often located low in the boat and out of the way, which limits its access and visibility. The prior art procedures for removing the pump are cumbersome and inefficient.

U.S. Pat. No. 5,538,406 discloses a removable cartridge-type pump in which a motor connected to one part of the housing may be removed from another part of the housing. This pump arrangement uses a bayonet or screw connection as well as a locking sear to keep the two parts of the housing together. In order to remove the motor in one embodiment (FIG. 12), the operator must push down a leg 94 of the sear 91 and rotate the motor portion 15 of the pump before removing the motor. In another embodiment (FIGS. 13 and 14), the sear 105 is pulled outward and the motor portion 15 is rotated. In another embodiment (FIG. 15), because the motor portion 15 is formed with external threads which mate with threads 45 on the housing 12, the motor portion 15 must be rotated to be removed. These rotating movements are cumbersome, especially when coupled with moving the sears 91, 105. There is a need in the prior art for a simpler way to remove the motor and pump from a housing connected to the boat transom.

SUMMARY

The disadvantages of the prior art are overcome to a great extent by the present invention, which provides a live well pump that is capable of being removed easily.

The present invention provides a pump for use in marine environments. The pump includes a pump housing including a cap portion, a main portion and a base, with the main portion including a pair of raised surfaces. Each of the surfaces slopes from a low end to a high end. The pump further includes a motor housing adapted to receive a motor, and a pair of pivotable clips. The cap portion is adapted to be in an unlocked position with each clip positioned over the low end of a respective raised surface and a locked position with each clip positioned over the high end of a respective raised surface.

The present invention also provides a pump for use in marine environments which includes a pump housing having a cap portion, a main portion and a base. Each of the cap and main portions have an outer circumference. The pump also includes a motor housing adapted to receive a motor, the motor housing including a flange extending radially outwardly beyond said outer circumferences of the cap and main portions, and a locking mechanism positionable over the flange to secure the cap portion to said main portion.

The present invention further provides a method of assembling a pump for use in marine environments. The method includes the steps of inwardly depressing one or more clips extending from a cap portion, positioning the cap portion over a main portion such that the clips extend over a pair of raised surfaces, each raised surface sloping from a low end to a high end, and rotating the cap portion from an unlocked position to a locked position.

The present invention further provides a method of assembling a pump for use in marine environments. The method includes positioning a cap portion over a main portion, the cap portion including a motor housing which contains a motor and which has a flange extending beyond an outer circumference of the cap and main portions, positioning a ring over the motor flange, the ring having a radially inwardly directed upper flange, one or more openings extending through the upper flange, and a plurality of radially inwardly directed protrusions on a lower extent of the ring, and rotating the ring such that the motor housing flange is locked between the upper flange and the protrusions.

It is an object of the present invention to provide a removable live well pump that is removable from the intake pipe.

It is another object of the invention to provide a removable live well pump that is capable of being disengaged with one hand.

Other objects, features and advantages of the present invention will become apparent from the following detailed description and drawings of the preferred embodiments of the present invention.

DETAILED DESCRIPTION OF PREFERRED EMBODIMENTS

Figure 1:
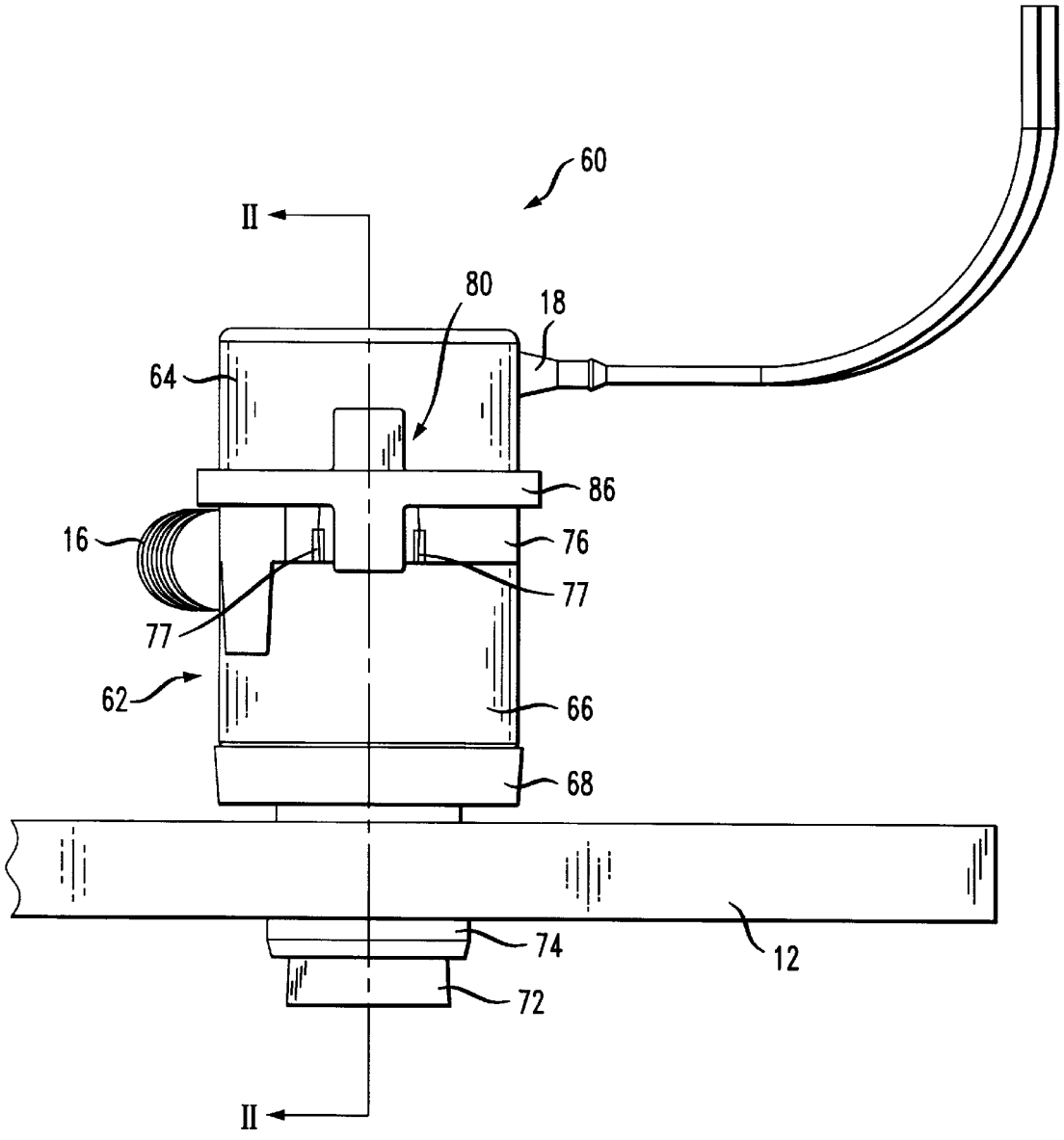
FIG. 1 is a side view of a removable live well pump constructed in accordance with a preferred embodiment of the present invention.
Figure 2:
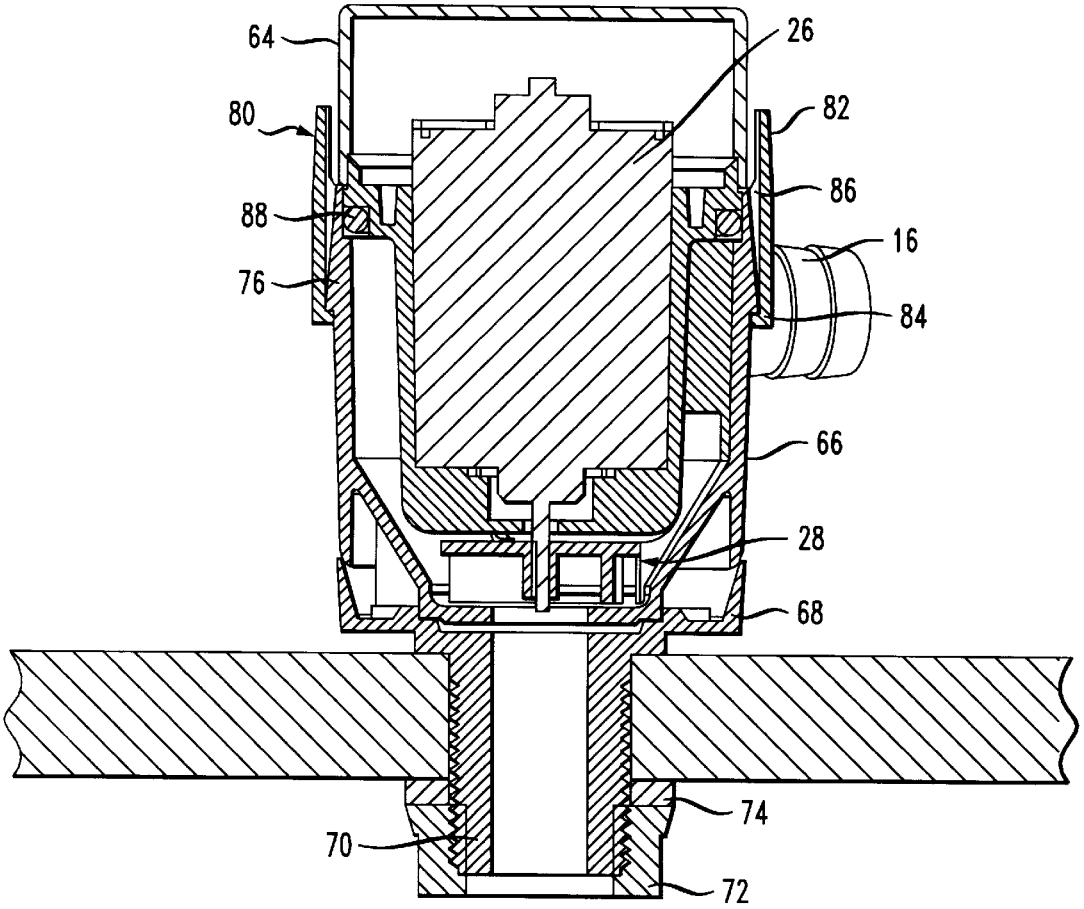
FIG. 2 is a cross-sectional view taken along line II—II of FIG. 1.
Figure 3:
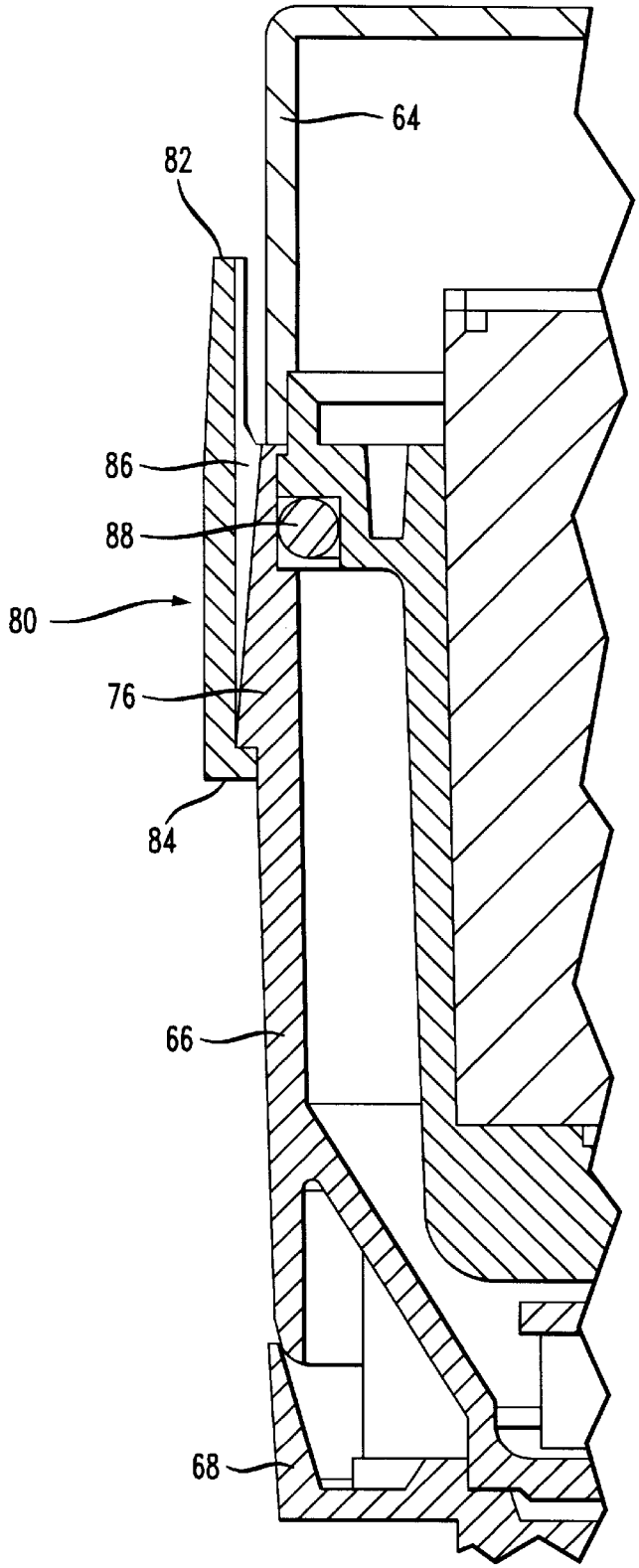
FIG. 3 is a blown up view of FIG. 2 showing the locking mechanism.

Referring now to the drawings, where like parts are designated by like reference numbers throughout, there is shown in FIGS. 1–3 a preferred embodiment of a live well pump 60 constructed according to the present invention. Although a live well pump is illustrated, it is to be understood that a bilge pump or any other suitable pump for use in marine environments is within the scope of the present invention.

An intake pipe 70 runs through a boat transom 12, which is attached to the boat bottom (not shown). The intake pipe 70 is in communication with a pump housing 62, which in turn is in communication with a flexible discharge pipe 16. The intake pipe 70 is mounted to the boat transom 12 under the boat's water line. The pump housing 62 contains the pump assembly which includes a pump 28 and a motor 26 that powers the pump 28. The pump 28 draws water in through the intake pipe 70 and out through the discharge pipe 16 to the live bait tank (not shown). A drain tube (not shown) allows overflow from the tank to return to the water.

The pump housing 62 includes a housing cap portion 64, a housing main portion 66, and a housing base 68. The housing base 68 is bolted to the housing main portion 66. The intake pipe 70 is integrally formed with the housing base 68 and the discharge pipe 16 is connected to the housing main portion 66. The housing cap portion 64 is removable from the housing main portion 66. When the housing cap portion 64 is removed from the housing main portion 66, the motor 26 and pump 28 remain attached to the housing cap portion 64 and the intake pipe 70 and discharge pipe 16 remain attached to the housing main portion 66. Attached to the housing cap portion 64 is a non-detachable power cord 18.

An O-ring 88 is disposed between the housing cap portion 64 and the housing main portion 66. The O-ring 88 provides a seal that prevents water from escaping from the pump housing 62.

The pump housing 62 includes a snap fit locking mechanism 80. The locking mechanism includes a first locking portion 80 located on the housing cap portion 64 and a second portion 76 located on the housing main portion 66. In a preferred embodiment, the first locking portion 80 is a pair of pivotable clips 80 and the second locking portion is a flange 76 formed on the circumference of the housing main portion 66. In a preferred embodiment, a pair of stops 77 are positioned on the flange 76. The stops 77 prevent rotation of the housing cap portion 64 relative to the housing main portion 66 by engaging one of the clips 80. In an alternative embodiment, a second pair of stops 77 may be place diametrically opposed to the first pair of stops 77 to engage the second of the clips 80.

The clips 80 are located diametrically opposite each other. Each pivotable clip 80 includes a lever portion 82 and a hook portion 84 both connected to the housing cap portion 64 at a pivot point 86. The lever portion 82 and hook portion 84 are integrally formed with the housing cap portion 64. The hook portion 84 is sized to engage the flange 76. The pivot point 86 may be a narrowed plastic portion, such as a live hinge.

To assemble the housing cap portion 64 to the housing main portion 66, the operator depresses the lever portions 82 radially inwardly towards the housing cap portion 64. The clips 80 pivot about the pivot point 86 to cause the hook portion 84 to move radially outwardly. The operator then pushes the housing cap portion 64 towards the housing main portion 66 to depress the O-ring 88. Once the hook portions 84 clear the flange 76, the operator releases the lever portions 82 and the natural resiliency of the clips 80 causes the hook portions 84 to snap radially inwardly and engage the flange 76 to lock the housing cap portion 64 to the housing main portion 66, as shown FIGS. 2 and 3.

To remove the housing cap portion 64, the operator moves the levers portions 82 radially inwardly, which causes the clips 80 to pivot about the pivot point 86 and the hook portions 84 to dislodge from the flange 76. The operator may plug the intake pipe 70 once the housing cap portion 64 is removed. Removing the housing cap portion 64 exposes the pump 28 and motor 26 so that the operator may repair, clean, or replace either component while the discharge pipe 16 and intake pipe 70 remain assembled.

FIGS. 4–9 show a bilge pump 160 according to another preferred embodiment of the present invention. It is to be understood that a live well pump or other suitable pump for use in marine environments is within the scope of the present invention. The pump 160 has a pump housing 162 including a cap portion 164, a main portion 166, and a base 168. A motor housing 127 (FIGS. 4, 8) is housed within the main portion 166 and holds the motor 26. The discharge tube 16 extends generally tangentially from the outer surface of the main portion 166.

On an interior surface of the main portion 166 is a groove 167. The motor housing 127 includes a flange 129. An O-ring 188 is positionable between the groove 167 and the flange 129 preventing exposure of the boat (not shown) to fluid when the cap portion 164 is properly seated against the main portion 166.

Figure 4:
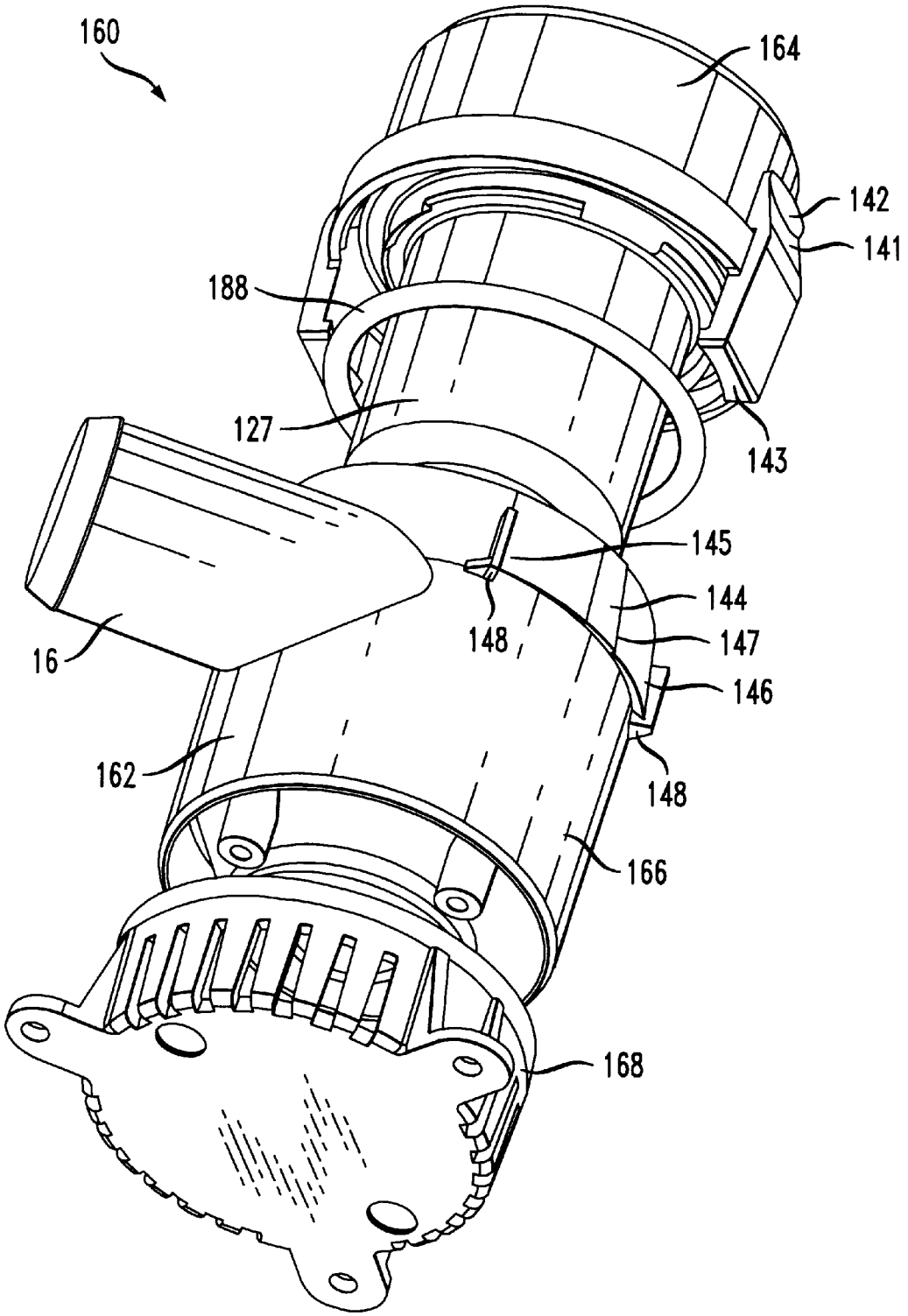
FIG. 4 is a perspective view of a bilge pump constructed in accordance with another preferred embodiment of the present invention.
Figure 5:
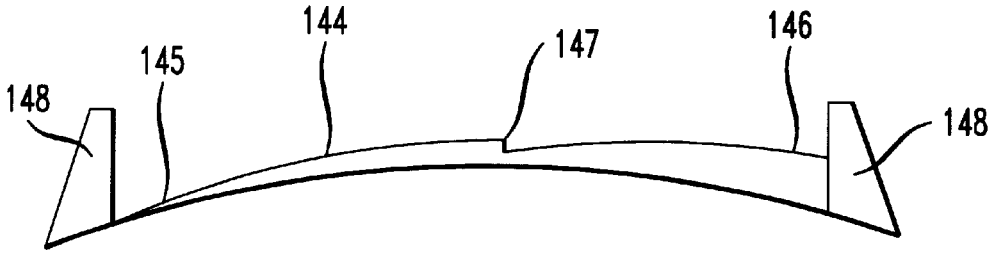
FIG. 5 is a view from the bottom of the ramp of FIG. 4.
Figure 6:
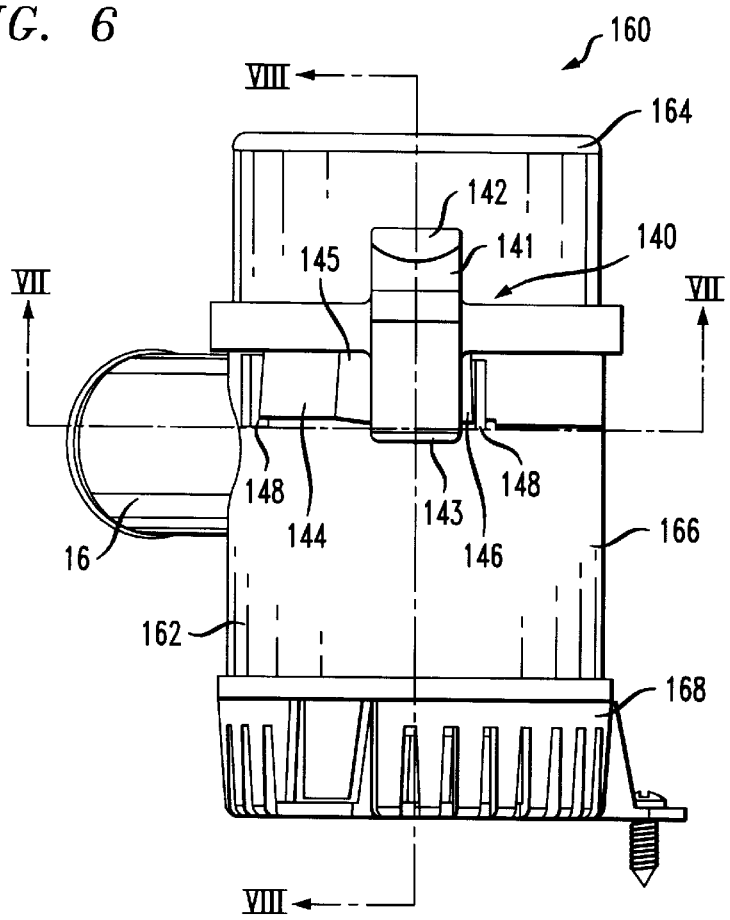
FIG. 6 is a side view of the bilge pump of FIG. 4.
Figure 7:
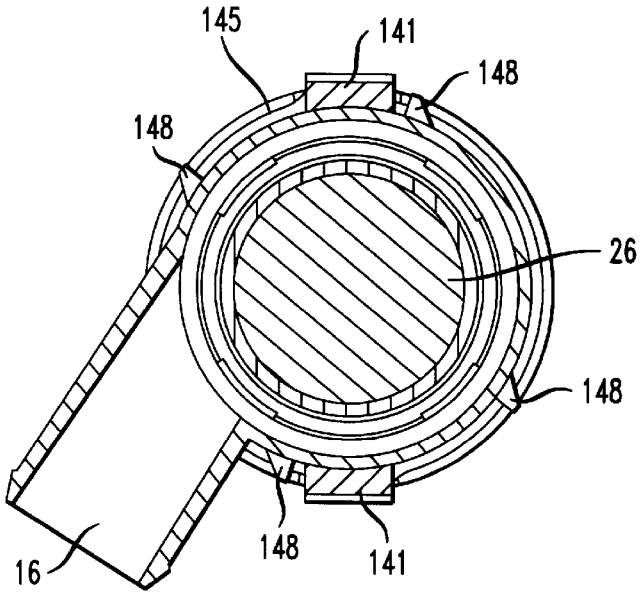
FIG. 7 is a cross-sectional view taken along line VII—VII of FIG. 6.
Figure 8:
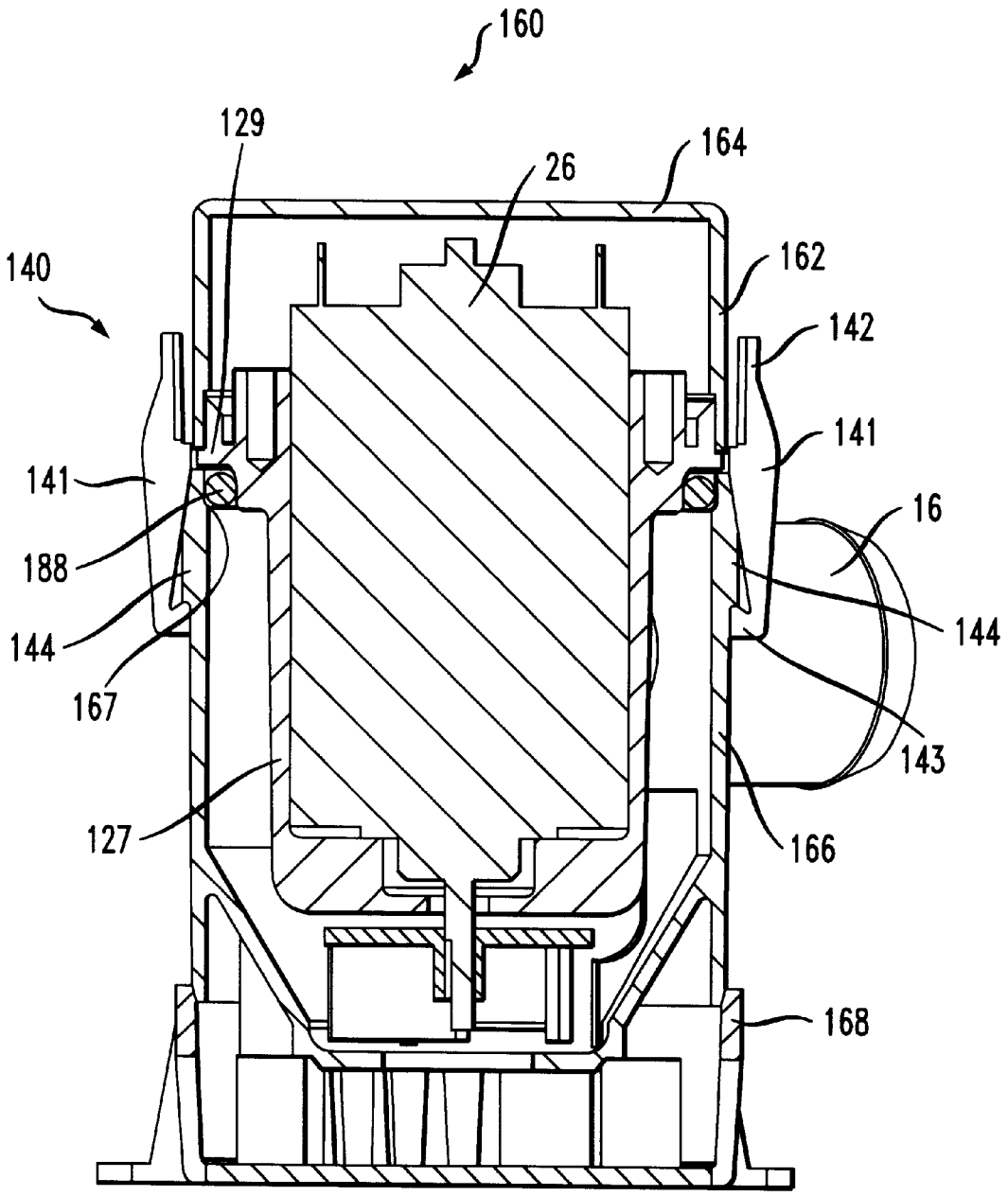
FIG. 8 is another cross-sectional view taken along line VIII—VIII of FIG. 7.
Figure 9:
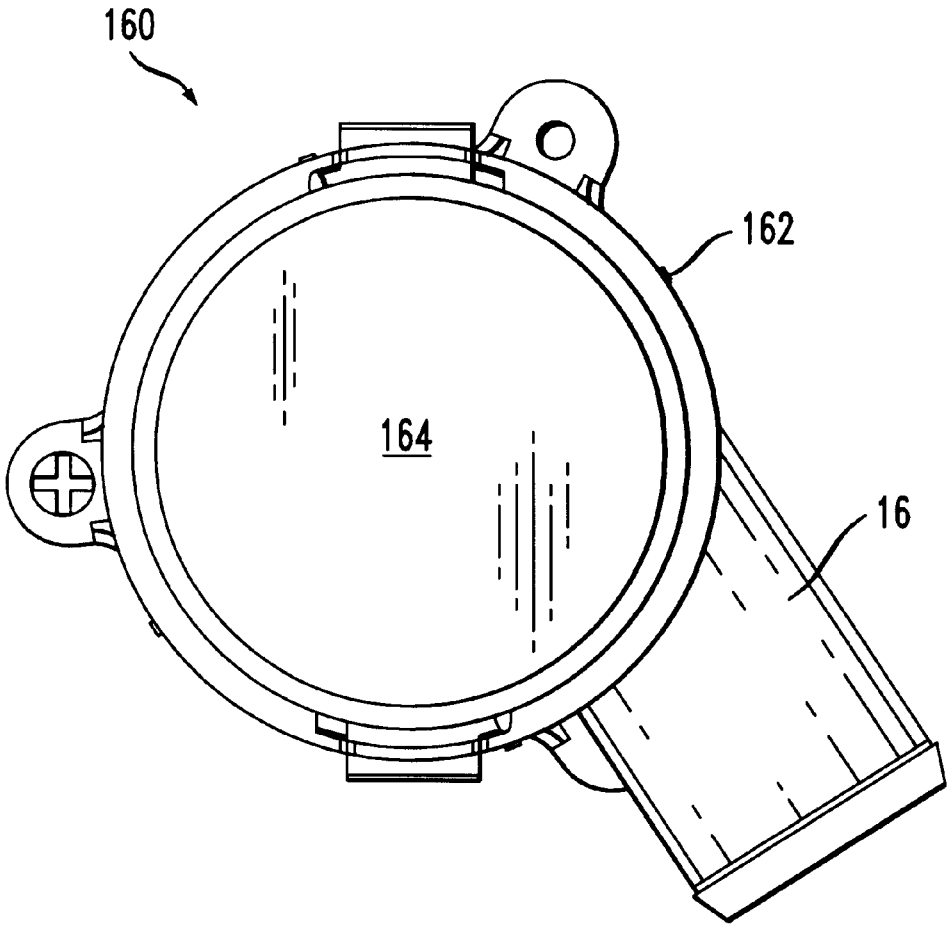
FIG. 9 is a top view of the bilge pump of FIG. 4.
Figure 10:
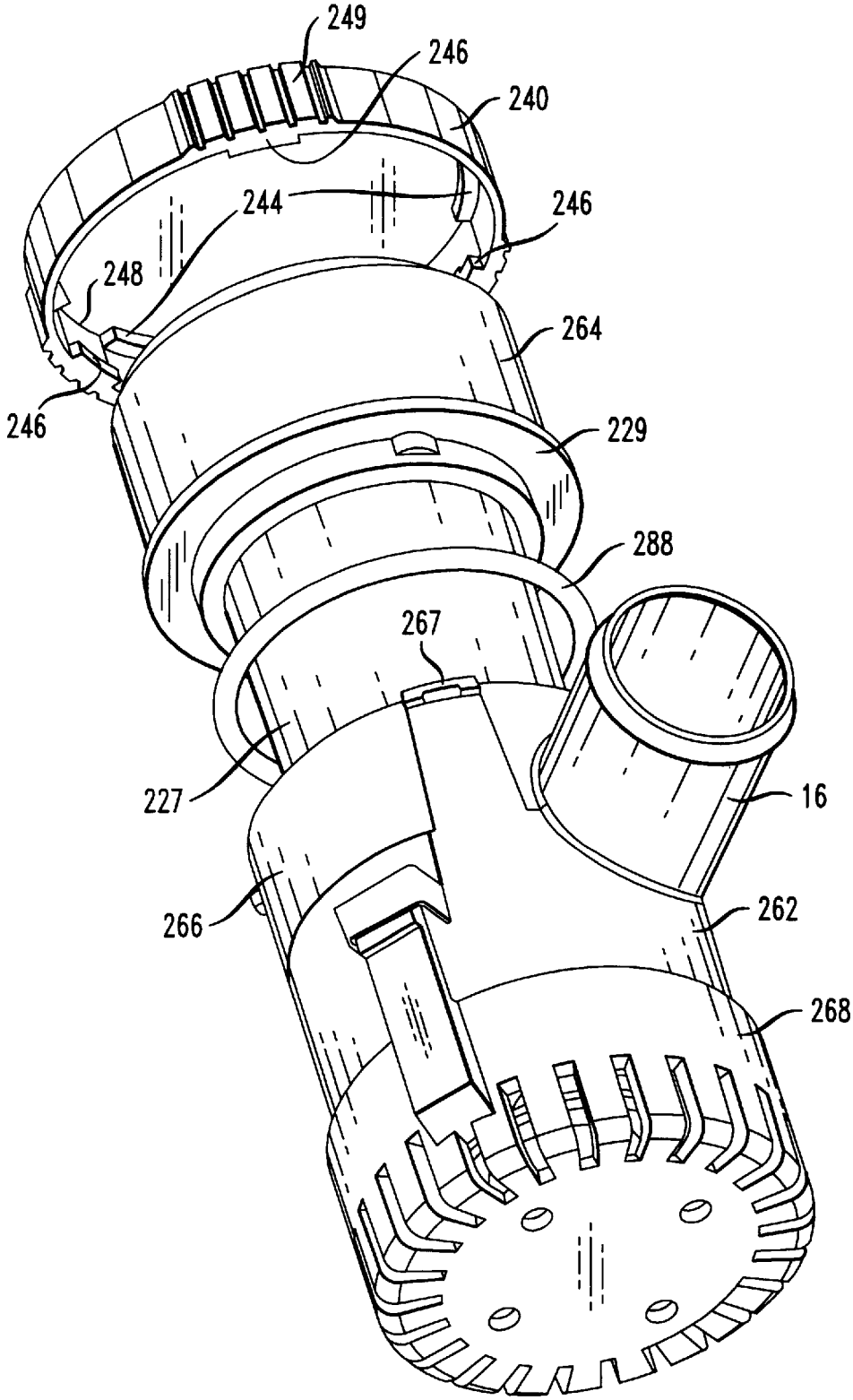
FIG. 10 is a perspective view of a bilge pump constructed in accordance with another preferred embodiment of the present invention.
Figure 11:
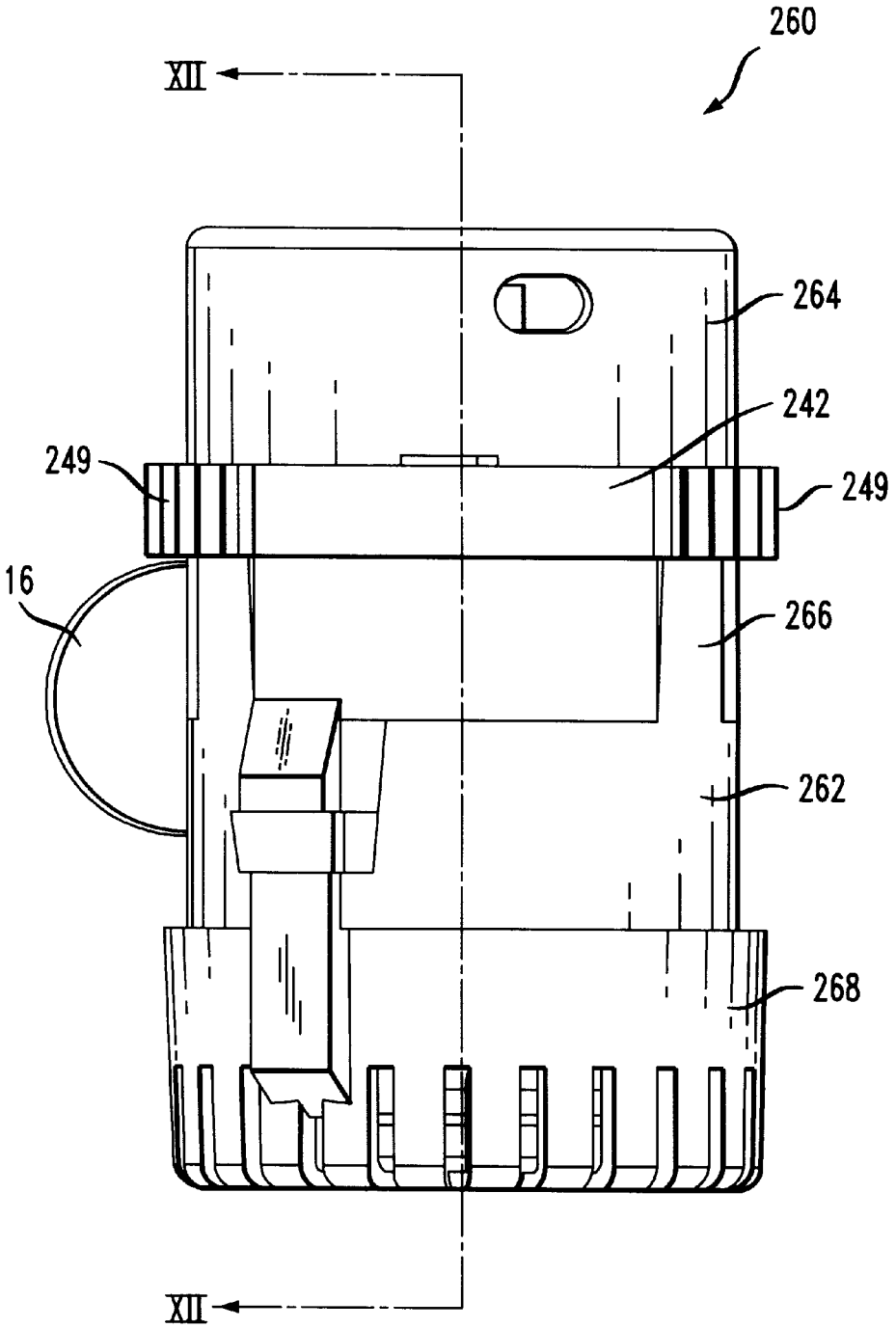
FIG. 11 is a side view of the bilge pump of FIG. 10.

The cap portion 164 is attachable to and removable from the main portion 166 by way of a locking mechanism 140. The locking mechanism 140 includes a first locking portion 141 and a second locking portion 144. Preferably, the first locking portion 141 includes a pair of pivotable clips 141, each having a lever portion 142 and a hook portion 143. The second locking portion 144 is preferably a sloping ramp 144 having a lower end 145 and a high end 146 positioned between a pair of stops 148. The ramp 144 has a surface raised radially outwardly from the outer circumference of the main portion. The lower end 145 is not raised as far outwardly as the high end 146. At a mid-portion between the lower end 145 and the high end 146 is a ledge 147 (FIGS. 4–5).

To attach the cap portion 164 to the main portion 166, the lever portions 142 are depressed radially inwardly and the cap portion 164 is placed on the main portion 166. The hook portions 143 settle over the lowest extent of the ramp 144. In this position, the cap portion 164 is unlocked. The pressure on the lever portions 142 is released, allowing the hook portions to contact an undersurface of the ramp 144.

The cap portion 164 is then rotated counter-clockwise (as viewed from the angle of FIG. 9) to allow each of the hook portions 143 to move from the lower ends 145 to the high ends 146. Here, the cap portion 164 is in a locked position. The cap portion 164 is inhibited from removal from the main portion 166 in this position because the lever portions 142 cannot be depressed enough to allow the hook portions 143 to clear the radial extent of the high ends 146. The ledge 147 prevents the hook portion 143 from sliding back in the direction of the lower end 145, hence maintaining the locking mechanism 140 in the locked position.

To remove the cap portion 164 from the main portion 166, the cap portion 164 is twisted clockwise (as viewed from the angle of FIG. 9), pressure is exerted on the lever portions 142 to depress them radially inwardly and the hook portions 143 become disengaged from the lowest extent of the ramps 144.

Through this arrangement, the cap portion 164 can be easily removed and attached one-handed. Preferably, the motor housing 127 is connected with the cap portion 164, and thus, removal of the cap portion 164 also removes the motor 26.

FIGS. 10–13 illustrate a bilge pump 260 constructed according to another preferred embodiment of the present invention. The pump 260 includes a pump body 262 which houses the motor 26. The housing 262 has three separate components, including a cap portion 264, a main portion 266, and a base 268. The discharge pipe 16 extends generally tangentially from the main portion 266.

Figure 12:
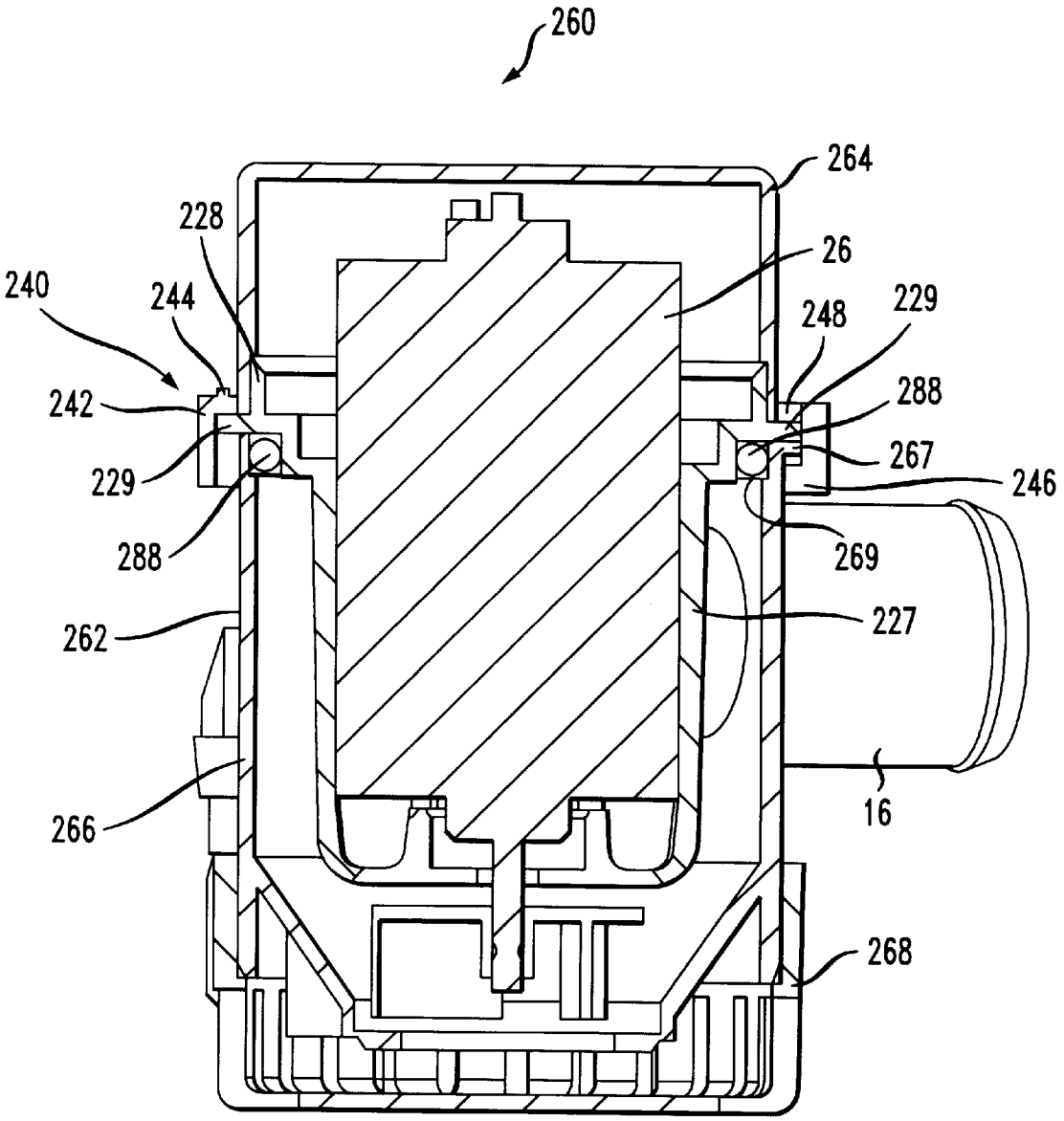
FIG. 12 is a cross-sectional view taken along line XII—XII of FIG. 11.
Figure 13:
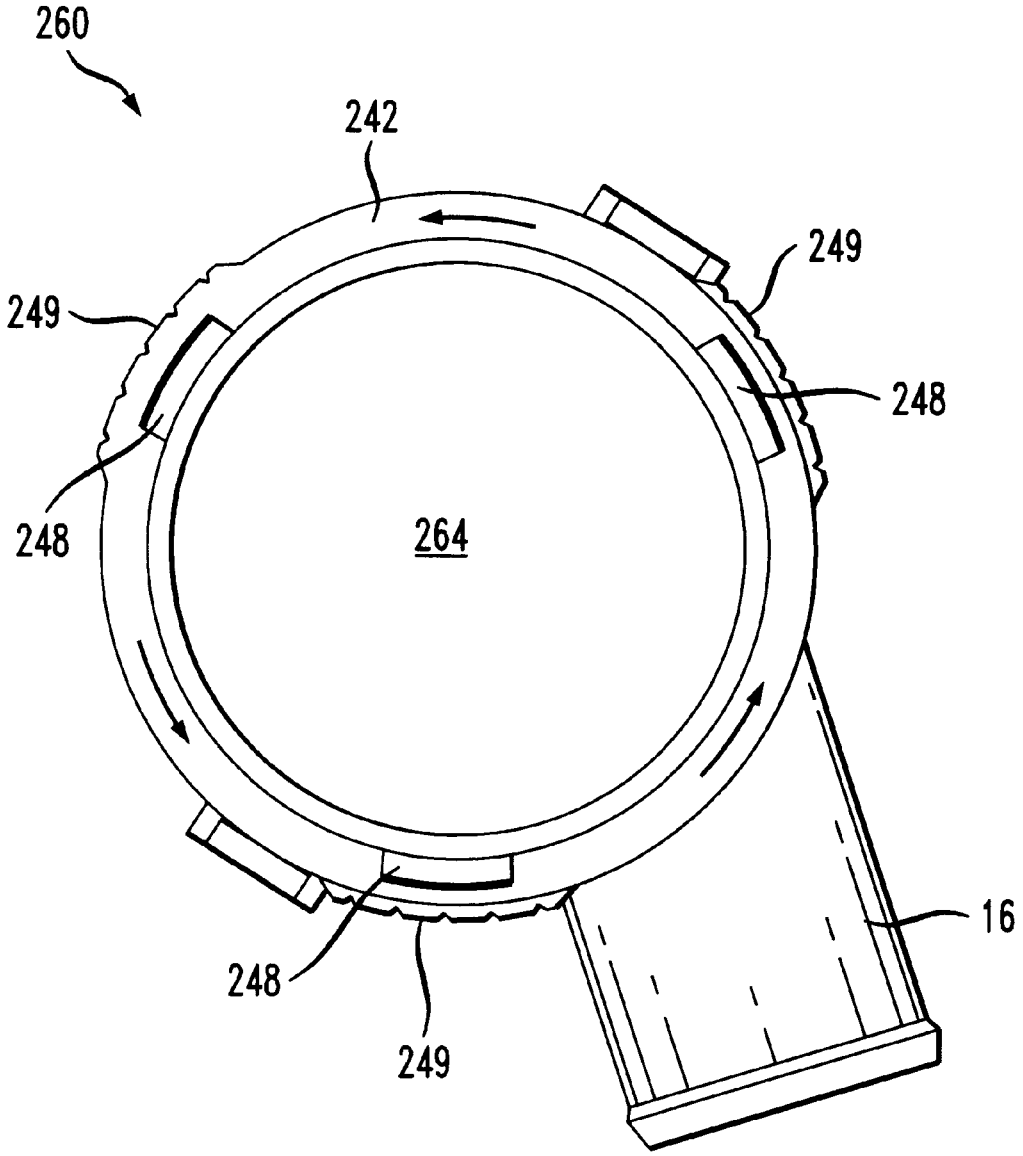
FIG. 13 is a top view of the bilge pump of FIG. 10.

With specific reference to FIG. 12, the motor 26 is housed within a motor housing 227. The motor housing 227 has an upper portion 228 and a radially outwardly extending flange 229. The flange 229 extends radially beyond the outer circumferences of the cap and main portions 264 and 266. The main portion 266 includes one or more flanges 267, each of which extends radially outwardly from the outer circumference of the main portion 266. The flanges 267 mate with the flange 229 when the motor housing 227 is properly positioned within the pump housing 262. A groove 269 extends around an inner circumference of the main portion 266. An O-ring 288 fits between the groove 269 and the flange 229 and serves to inhibit migration of fluid into the boat (not shown).

A locking mechanism 240 fits around the circumferences of and holds in place the cap and main portions 264, 266. The locking mechanism 240 includes a locking latch 242 which has an upper flange 244 and a plurality of lower protrusions 246, the flange 244 and the protrusions 246 extending radially inwardly. The upper flange 244 includes a plurality of openings 248. As the locking latch 242 is lowered over the flanges 229 and 267, open spaces between the protrusions 246 allow the protrusions 246 to get axially under the flange 267. By rotating the locking latch 242, the protrusions 246 rotate directly beneath the flange 267 and the upper flange 244 rides over the flange 229, thereby locking the main portion 266 with the cap portion 264. Latch pads 249 are located about the circumference of the locking latch 242 and assist in the rotation which locks and unlocks the latch 242.

While the foregoing has described in detail preferred embodiments known at the time, it should be readily understood that the invention is not limited to the disclosed embodiments. Rather, the invention can be modified to incorporate any number of variations, alterations, substitutions or equivalent arrangements not heretofore described, but which are commensurate with the spirit and scope of the invention. For example, although some embodiments provide for a counter-clockwise turn to remove the cap portion, instead the pump may be designed for clockwise removal of the cap portion.

What is claimed as new and desired to be protected by Letters Patent of the United States is:

1. A pump for use in marine environments, comprising:

a pump housing including a cap portion, a main portion and a base, said main portion including a pair of ramped raised surfaces, each said raised surface sloping from a low end to a high end;

a motor housing adapted to receive a motor;

a ledge positioned between said low end and said high end of each of said raised surfaces; and a pair of pivotable clips, wherein said cap portion is adapted to be in an unlocked position, with each said clip positioned over said low end of each respective said raised surface, and a locked position with each said clip positioned over said high end of the respective said raised surface.

2. The pump of claim 1, wherein each said clip includes a hook portion, said hook portions securing to said high ends of said raised surfaces.

3. The pump of claim 1, wherein said ledge prevents said hook portion from sliding out of said locked position.

4. The pump of claim 2, wherein each said clip includes pivotable lever portions.

5. The pump of claim 1, further comprising an O-ring positioned between said cap portion and said main portion.

6. The pump of claim 5, wherein said main portion includes a circumferentially directed groove about an interior surface and said cap portion includes a radially outwardly directed flange, said O-ring being positioned between said groove and said flange.

7. The pump of claim 1, wherein the pump is a live well pump.

8. The pump of claim 1, wherein the pump is a bilge pump.

9. A pump for use in marine environments, comprising:

a pump housing including a cap portion, a main portion and a base, said main portion including a pair of ramps sloping from a low end to a high end;

a motor housing adapted to receive a motor; and a pair of pivotable clips, wherein said cap portion is adapted to be in an unlocked position with each said clip positioned over said low end of a respective said raised surface and a locked position with each said clip positioned over said high end of the respective said raised surface.

10. The pump of claim 9, further comprising a ledge positioned between said low end and said high end of said raised surface.

11. The pump of claim 9, wherein each said clip includes pivotable lever portions.

12. The pump of claim 10, wherein said ledge prevents said hook portion from sliding out of said locked position.

13. The pump of claim 9, further comprising an O-ring positioned between said cap portion and said main portion.

14. The pump of claim 13, wherein said main portion includes a circumferentially directed groove about an interior surface and said cap portion includes a radially outwardly directed flange, said O-ring being positioned between said groove and said flange.

15. The pump of claim 9, wherein the pump is a live well pump.

16. The pump of claim 9, wherein the pump is a bilge pump.

17. A pump for use in marine environments, comprising:

a pump housing including a cap portion, a main portion and a base, each said cap and main portion having an outer circumference;

a motor housing adapted to receive a motor, said motor housing including a flange extending radially outwardly beyond said outer circumferences of said cap and main portions; and a locking mechanism positionable over said flange to secure said cap portion to said main portion.

18. The pump of claim 17, wherein said locking mechanism comprises a ring having a radially inwardly directed upper flange, one or more openings extending through said upper flange, and a plurality of radially inwardly directed protrusions on a lower extent of said ring.

19. The pump of claim 18, wherein said main portion includes one or more radially outwardly directed flanges which mate with said motor housing flange, said ring fitting around said motor housing and main portion flanges.

20. The pump of claim 18, wherein said ring includes one or more pads.

21. The pump of claim 18, further comprising an O-ring positioned between said cap portion and said main portion.

22. The pump of claim 21, wherein said main portion includes a circumferentially directed groove about an interior surface, said O-ring being positioned between said groove and said motor housing flange.

23. The pump of claim 17, wherein the pump is a live well pump.

24. The pump of claim 17, wherein the pump is a bilge pump.

25. A method of assembling a pump for use in marine environments including a cap portion, a main portion and a base, said method comprising the steps of:

inwardly depressing one or more clips extending from said cap portion positioning said cap portion over said main portion such that said clips extend over a pair of raised surfaces, each said surface sloping from a low end to a high end; and rotating said cap portion from an unlocked position to a locked position.

26. The method of claim 25, wherein said cap portion moves from said unlocked position to said locked position by said clips moving over said raised surfaces from said low end to said high end and by releasing pressure on said clips, thereby allowing said clips to hook onto said high ends.

27. The method of claim 26, further comprising inhibiting movement of said clips from said high end back to said low end.

28. The method of claim 27, wherein said inhibiting movement of said clips comprises locating a ledge at a mid-portion between said low end and said high end.

29. The method of claim 28, wherein said ledge prevents said clips from moving from the locked position to the unlocked position.

30. The method of claim 25, wherein said cap portion includes a motor housing having a flange and containing a motor and said main portion includes a circumferentially directed groove on an inner surface, further comprising positioning an O-ring between said groove and said motor housing flange.

31. A method of assembling a pump for use in marine environments including a cap portion, a main portion and a base, said method comprising the steps of:

positioning said cap portion over a main portion, said cap portion including a motor housing which contains a motor and which has a flange extending beyond an outer circumference of said cap and main portions;

positioning a ring over said motor flange, said ring having a radially inwardly directed upper flange, one or more openings extending through said upper flange, and a plurality of radially inwardly directed protrusions on a lower extent of said ring; and rotating said ring such that said motor housing flange is locked between said upper flange and said protrusions.

32. The method of claim 31, wherein said main portion includes one or more radially outwardly directed flanges which mate with said motor housing flange, said ring fitting around said motor housing and main portion flanges.

* * * * *